US009581331B2

(12) United States Patent
Broker et al.

(10) Patent No.: US 9,581,331 B2
(45) Date of Patent: Feb. 28, 2017

(54) CONTROL OF STEPPER MOTOR OPERATED GAS VALVE

(75) Inventors: John F. Broker, Warrenton, MO (US); Mike Santinanavat, Chesterfield, MO (US); Juan Ling, Suzhou (CN); Xingeng Zhou, Suzhou (CN)

(73) Assignee: Emerson Electric Co., St. Louis, MO (US)

( * ) Notice: Subject to any disclaimer, the term of this patent is extended or adjusted under 35 U.S.C. 154(b) by 1171 days.

(21) Appl. No.: 13/031,517

(22) Filed: Feb. 21, 2011

(65) Prior Publication Data

US 2012/0214117 A1 Aug. 23, 2012

(51) Int. Cl.
*F23N 1/02* (2006.01)
*F23N 1/00* (2006.01)

(52) U.S. Cl.
CPC ..... *F23N 1/00* (2013.01); *F23N 1/002* (2013.01); *F23K 2900/05002* (2013.01); *F23N 2035/16* (2013.01); *F23N 2035/20* (2013.01)

(58) Field of Classification Search
CPC ..... F23N 1/00
USPC ..... 432/47; 431/12; 251/30.01
See application file for complete search history.

(56) References Cited

U.S. PATENT DOCUMENTS 3,939,456 A * 2/1976 Curtis et al. ..... 340/519
4,129,813 A 12/1978 Hunts et al. ..... 318/561
4,986,468 A 1/1991 Deisinger ..... 236/21 R
5,084,791 A * 1/1992 Thanos ..... G11B 5/5556 360/77.03
5,118,072 A 6/1992 Sakamoto et al.
5,303,561 A 4/1994 Bahel et al. ..... 62/186
(Continued)

FOREIGN PATENT DOCUMENTS

CN 101501382 8/2009
CN 101701644 5/2010
(Continued)

OTHER PUBLICATIONS

Intelligent Motion Systems, Inc., IM483 & IM805 High Performance Microstepping Drivers, Jan. 25, 2008, R012508, All.*
(Continued)

*Primary Examiner* — Alissa Tompkins
*Assistant Examiner* — John Bargero
(74) *Attorney, Agent, or Firm* — Harness, Dickey & Pierce, P.L.C.

(57) ABSTRACT

A controller is provided for a gas valve including a movable valve element, a main diaphragm chamber having a main diaphragm therein coupled to the valve element to displace the valve element relative to a valve opening, and a servo-regulator diaphragm for regulating flow of gas that acts against the main diaphragm, to adjust the valve element and vary the flow rate. A stepper motor is configured to move in a stepwise manner to displace the servo-regulator diaphragm to adjust the valve element and gas flow rate. The controller for the stepper motor includes a microprocessor that receives an input signal indicating an operating capacity level, and determines the steps the stepper motor must move to displace the servo-regulator diaphragm to establish a flow rate corresponding to the operating capacity level. The microprocessor generates a signal to move the stepper motor the number of steps to adjust the gas valve.

18 Claims, 6 Drawing Sheets

(56) References Cited

U.S. PATENT DOCUMENTS

| | | | | |
|---|---|---|---|---|
| 5,428,470 | A * | 6/1995 | Labriola, II | G01N 35/00584 398/109 |
| 5,632,614 | A | 5/1997 | Consadori et al. | 431/79 |
| 5,722,064 | A | 2/1998 | Campana, Jr. | 455/351 |
| 5,917,691 | A | 6/1999 | Kadah | 361/154 |
| 6,000,390 | A | 12/1999 | Evers et al. | 126/42 |
| 6,093,152 | A | 7/2000 | Patterson | 600/495 |
| 7,020,543 | B1 | 3/2006 | Jaeschke et al. | 700/275 |
| 7,076,373 | B1 | 7/2006 | Munsterhuis et al. | 702/51 |
| 7,191,039 | B2 | 3/2007 | Jaeschke et al. | |
| 7,591,245 | B2 | 9/2009 | Baasch et al. | 123/399 |
| 7,938,382 | B2 | 5/2011 | Huerta-Ochoa et al. | |
| 8,381,760 | B2 | 2/2013 | Santinanavat et al. | |
| 2002/0099455 | A1* | 7/2002 | Ward | 700/83 |
| 2005/0000580 | A1* | 1/2005 | Tranovich et al. | 137/625.65 |
| 2008/0054837 | A1* | 3/2008 | Beavis | F04B 13/02 318/696 |
| 2010/0009303 | A1 | 1/2010 | Santinanavat et al. | |
| 2010/0179700 | A1* | 7/2010 | Lorenz | F16K 31/04 700/282 |

FOREIGN PATENT DOCUMENTS

| | | |
|---|---|---|
| JP | 2002276827 | 9/2002 |
| WO | WO92/12474 | 7/1992 |

OTHER PUBLICATIONS

SGS-Thomson Microelectronics, L297 &L297D Stepper Motor Controllers, Aug. 2008, All.*

PIC18FXX2 Data Sheet, Microchip Technology, Inc., 2002, DS39564B,All.*

* cited by examiner

CONTROL OF STEPPER MOTOR OPERATED GAS VALVE

FIELD

The present disclosure relates to systems for control of an appliance incorporating a flame, and more particularly relates to valve control of a fuel to such an appliance.

BACKGROUND

The statements in this section merely provide background information related to the present disclosure and may not constitute prior art.

A gas-fired, warm air furnace that operates at two or more gas flow rates is generally referred to as a variable or multistage furnace. Multistage furnaces are frequently selected by homeowners for replacement of existing furnaces because they offer increased performance and comfort. However, in multi-stage or variable heating furnaces, the furnace control is only configured for one-way communication with a gas valve. This typically is in the form of a signal applying a voltage source or a variable current signal to the gas valve. However, such signals are not capable of providing feedback, and may not be compatible with replacement or retrofit of gas valves or other components of the furnace. Accordingly, a need still exists for an improved control of variable stage heating systems.

SUMMARY

Further areas of applicability will become apparent from the description provided herein. It should be understood that the description and specific examples are intended for purposes of illustration only and are not intended to limit the scope of the present disclosure.

Various embodiments are provided of a controller for a variable output heating apparatus having a stepper motor operated gas valve. One embodiment of a controller for controlling a stepper motor operated gas valve in a variable heating apparatus is provided. The stepper motor operated gas valve includes a valve element movable relative to a valve opening in the gas valve, a main diaphragm chamber disposed in the gas valve, and a main diaphragm disposed in the main diaphragm chamber that is coupled to the valve element. The main diaphragm is configured to controllably displace the valve element relative to the valve opening in response to changes in gas pressure acting against the main diaphragm. The stepper motor operated gas valve further includes a servo-regulator diaphragm configured to regulate flow of gas to the main diaphragm chamber that acts against the main diaphragm, to thereby adjust the valve element to vary the flow rate of gas through the valve opening. A stepper motor for the valve is configured to move in a stepwise manner to linearly displace the servo-regulator diaphragm for varying the flow of gas to the diaphragm chamber, to thereby control the rate of gas flow through the valve opening.

A controller for the stepper motor operated gas valve includes a microprocessor in communication with an input connector configured to receive an input signal indicating a specific level of heating operation, and a stepper motor position sensor configured to detect the stepwise movements of the stepper motor. The microprocessor is configured to detect the presence of an input signal that is indicative of a specific operating capacity level at which to operate the variable heating apparatus. The microprocessor further includes a programmable read-only-memory encoded with one or more instructions operable to determine the number of steps the stepper motor must move to displace the servo-regulator diaphragm to establish a flow rate corresponding to the specific operating capacity level. The microprocessor is configured to generate a control signal instructing the stepper motor operated gas valve to move the determined number of steps, compare the determined number of steps with the number of steps detected by the stepper motor position sensor to verify the position of the stepper motor, and thereafter generate an output signal confirming operation of the stepper motor.

Further areas of applicability will become apparent from the description provided herein. The description and specific examples in this summary are intended for purposes of illustration only and are not intended to limit the scope of the present disclosure.

DRAWINGS

The drawings described herein are for illustration purposes only and are not intended to limit the scope of the present disclosure in any way.

Corresponding reference numerals indicate corresponding parts throughout the several views of the drawings.

DETAILED DESCRIPTION

Figure 1:
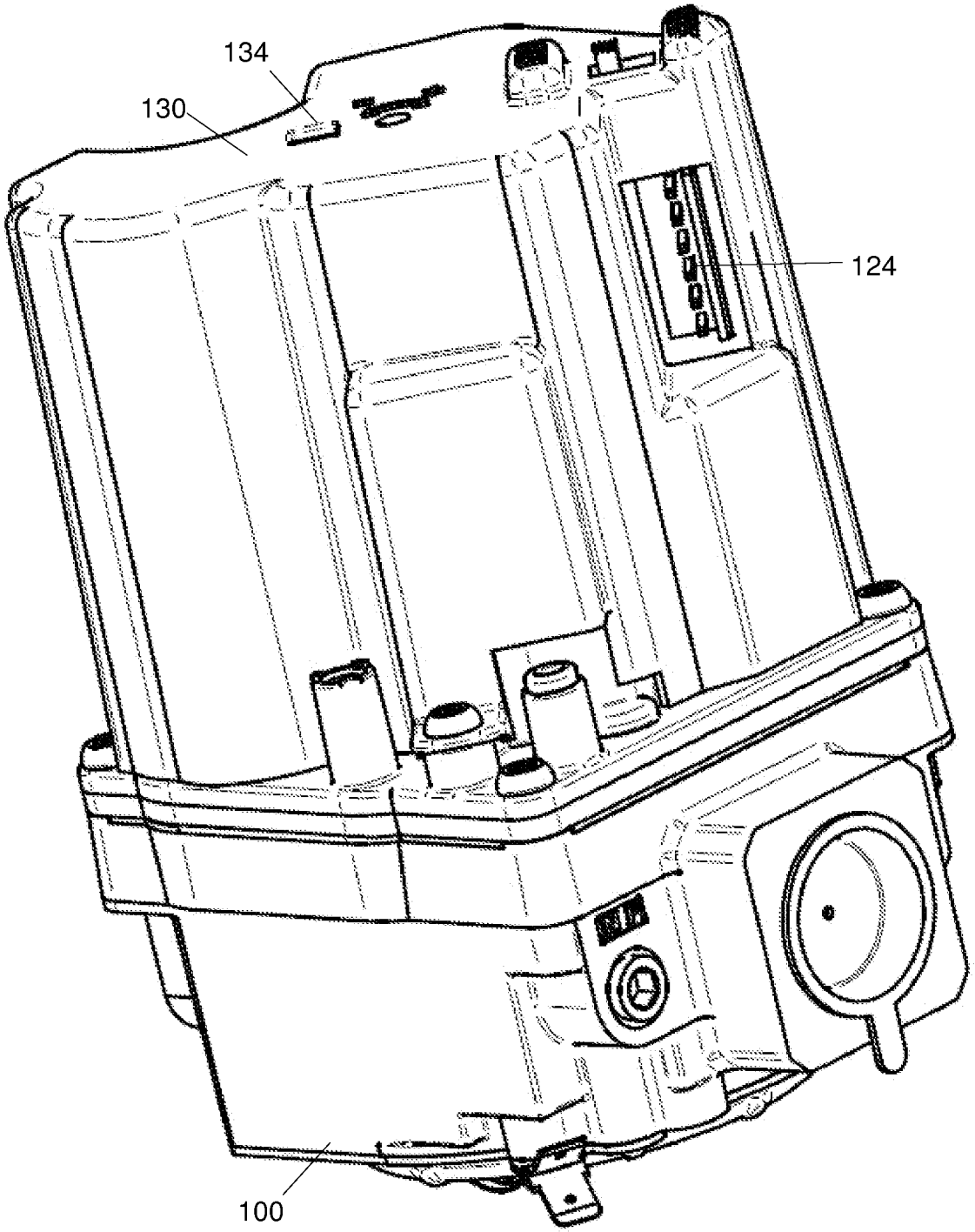
FIG. 1 is a perspective view of one embodiment of a controller positioned relative to a stepper motor operated gas valve, for controlling the stepper motor according to the principles of the present disclosure.

The following description is merely exemplary in nature and is not intended to limit the present disclosure, application, or uses. It should be understood that throughout the drawings, corresponding reference numerals indicate like or corresponding parts and features.

In the various embodiments of the present disclosure, a controller for a variable heating apparatus is provided that is configured to control a stepper motor operated gas valve. In the various embodiments, the controller is utilized in combination with a stepper motor operated gas valve configured to vary gas flow for varying the level of operation of a heating apparatus. The stepper motor operated gas valve includes a valve element movable relative to a valve opening in the gas valve, and a main diaphragm chamber having a main diaphragm disposed therein that is coupled to the valve element. The main diaphragm is configured to controllably displace the valve element relative to the valve opening in response to changes in gas pressure acting against the main diaphragm. The stepper motor operated gas valve further includes a servo-regulator diaphragm configured to regulate flow of gas to the main diaphragm chamber that acts against the main diaphragm, to thereby adjust the valve element to vary the flow rate of gas through the valve opening. A stepper motor for the valve is configured to move in a stepwise manner to linearly displace the servo-regulator diaphragm for varying the flow of gas to the diaphragm chamber, to thereby control the rate of gas flow through the valve opening. A controller for the stepper motor operated gas valve includes a microprocessor, which is in communication with an electronic memory, an input connector that receives an input signal indicating a specific level of heating operation, and a stepper motor position sensor for detecting the stepwise movements of a stepper motor. The microprocessor is configured to detect the presence of an input signal that is indicative of a specific operating capacity level at which to operate the variable heating apparatus. The microprocessor further includes a programmable read-only-memory encoded with one or more instructions operable to determine the number of steps the stepper motor must move to displace the servo-regulator diaphragm and establish a flow rate corresponding to the specific operating capacity level. The microprocessor is further configured to (1) generate a control signal that causes the stepper motor that operates the gas valve to move the determined number of steps, (2) compare the determined number of steps with the number of steps detected by the stepper motor position sensor to verify the position of the stepper motor, and (3) thereafter generate an output signal confirming operation of the stepper motor, as explained below.

According to one aspect of the present disclosure, embodiments are provided of a controller for controlling various types of stepper motor operated gas valves to establish a desired operating capacity level requested by a system or furnace control. One embodiment of a controller 130 for controlling a stepper motor operated gas valve 100 for a variable heating apparatus is shown generally in FIG. 1. The controller 130 includes an input connector 124, which is configured to receive an input signal from a furnace control, as described below.

Figure 2:
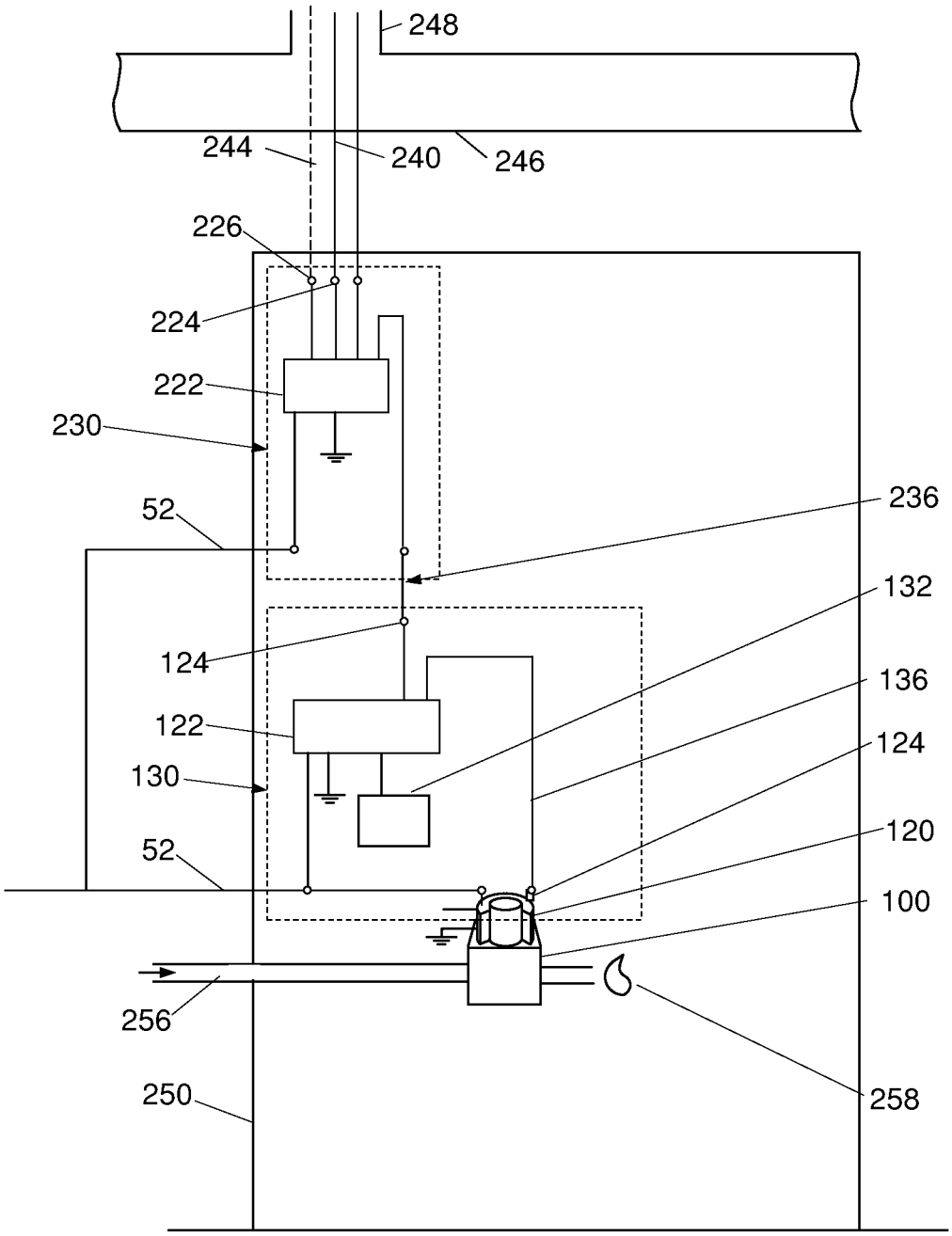
FIG. 2 is a schematic diagram of one embodiment of a controller for a stepper motor operated gas valve, in connection with a furnace controller for a heating appliance, according to the principles of the present disclosure.

In the embodiment shown in FIG. 2, the controller 130 for a stepper motor operated gas valve 100 is configured to receive a signal from a furnace controller 230, which determines the desired operating capacity level. The system or furnace controller 230 is coupled to a 24-volt power source 52, which supplies power to a microprocessor 222 of the furnace controller 230. The system or furnace controller 230 includes an input terminal 224 configured to receive a thermostat signal requesting heating operation via connection wire 240 passing through the flooring 246 and walls 248 of a space. The system or furnace controller 230 is configured to generate an input control signal that is input via connector 124 to the controller 130 for the stepper motor operated gas valve 100, which supplies a burner 258 with fuel.

Upon start-up of the variable heating system shown in FIG. 2, the microprocessor 222 of the system or furnace controller 230 is configured to detect a thermostat signal requesting heating via an input terminal 224 and to communicate an input control signal to the controller 130 for the stepper motor operated gas valve 100 to supply gas via line 256 for establishing heating operation at the burner 258. The controller 130 then controls the stepper motor operated gas valve 100 to continue operation of the variable capacity heating apparatus until such time when the thermostat discontinues the signal to input terminal 224. The system or furnace controller 230 may further include a second terminal 226 configured to receive a thermostat signal via an optional wire 244 requesting high-stage heating. Upon detecting a thermostat signal requesting high stage heating operation, the microprocessor 222 is configured to communicate a control signal via 236 to the controller 130 for the stepper motor operated gas valve 100 to supply gas via line 256 for establishing a higher level of heating at the burner 258. The system or furnace controller 230 is configured to operate the variable capacity heating apparatus between a minimum and maximum capacity depending on demand, as explained below.

The furnace controller 230 is configured to generate an input control signal to the controller 130 for establishing a select rate of gas flow that corresponds to a determined desired heating level. The microprocessor 222 of the furnace controller 230 includes a programmable read-only memory encoded with an instruction that is operable to determine a desired heating level based on the signal from the thermostat, or alternatively based on a time duration in which a thermostat signal was present at the input terminal 224 (e.g., the time that the variable capacity heating apparatus operated in a prior heating cycle). For example, if the heating apparatus operated at full capacity in the initial heating cycle for a time of 10 minutes (after which the thermostat signal to the input terminal 224 is discontinued), the microprocessor 222 may be configured to determine a new desired heating level that increases the level of the prior cycle by a predetermined percentage for each minute that the heating apparatus operated less than a threshold time period, such as 15 minutes for example. Such a furnace control is disclosed in U.S. patent application Ser. No. 12/729,716, filed Mar. 23, 2010, entitled "Stepper Motor Gas Valve and Method of Control." Alternatively, the furnace controller 230 may receive a thermostat signal via input terminal 224 that indicates a specific operating capacity level at which to operate the heating apparatus. In either situation, the system or furnace controller 230 is configured to respond to a thermostat signal requesting heating operation by outputting a control signal to the controller 130 for the stepper motor operated gas valve 100. The furnace controller 230 is preferably configured to generate an input control signal in the form of a pulse-width modulated (PWM) signal, to avoid the need for serial communication using a Universal Asynchronous Serial Port (UART) connection between the microprocessor 222 of the furnace controller 230 and the microprocessor of the controller 130 for controlling a stepper motor operated gas valve 100 described below.

Figure 3:
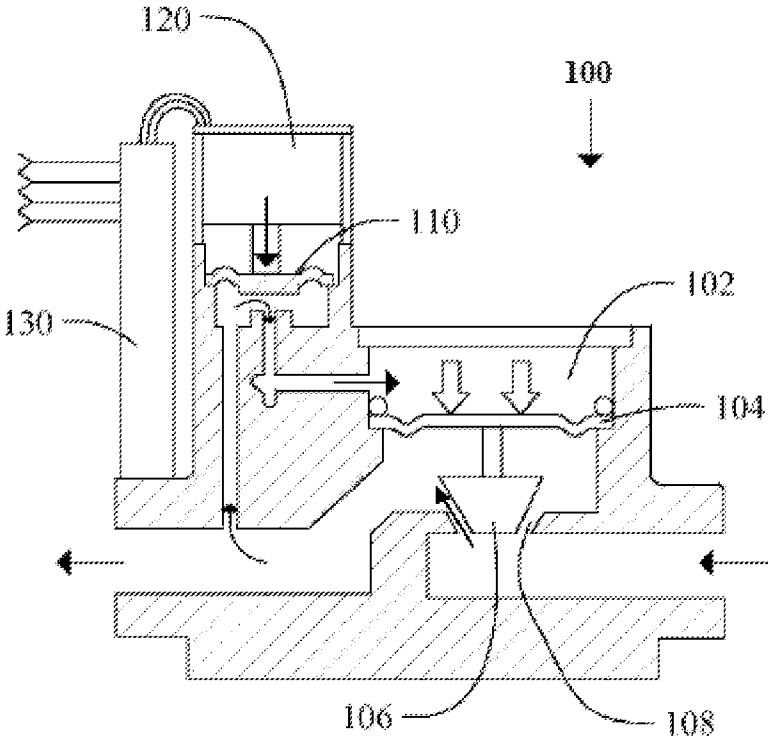
FIG. 3 shows a cut-away view of one embodiment of a stepper motor operated gas valve, according to the principles of the present disclosure.

Referring to FIG. 3, a stepper motor operated gas valve 100 is shown. The stepper motor operated gas valve 100 includes a main diaphragm chamber 102, and a main diaphragm 104 disposed therein that is coupled to a valve element 106. The main diaphragm 104 controllably displaces the valve element 106 relative to a valve opening 108 in response to changes in pressure in the main diaphragm chamber 102, to thereby permit adjustment of fuel flow through the valve opening 108. The stepper motor operated gas valve 100 further includes a servo-regulator diaphragm 110, which is configured to regulate fluid flow to the main diaphragm chamber 102. The servo-regulator diaphragm 110 therefore controls the fluid pressure applied to the main diaphragm 104, to control the rate of flow through the valve opening 108. The stepper motor operated gas valve 100 also includes a stepper motor 120 configured to move in a stepwise manner to displace the servo-regulator diaphragm 110, for regulating fluid flow to the diaphragm chamber 102 to regulate the rate of flow through the gas valve 100.

The stepper motor 120 accordingly provides control over the extent of the valve opening 108, to provide modulated gas flow operation. The stepper motor operated gas valve 100 preferably includes a controller 130 that includes a microprocessor 122 configured to receive an input control signal via a first connector 124 from the furnace controller 230, as shown in FIG. 2. The stepper motor gas valve 100 drives the stepper motor 120 in a step-wise manner to the desired stepper motor position, which causes the stepper motor 120 to displace the servo-regulator diaphragm 110 and valve element 106 the desired distance and thereby regulate the opening in the valve, to thereby control the rate of fuel flow through the valve opening 108. The microprocessor 122 determines the number of steps the stepper motor 120 must rotate to move the servo-regulator diaphragm 110 to establish the requested fuel flow level.

Figure 4:
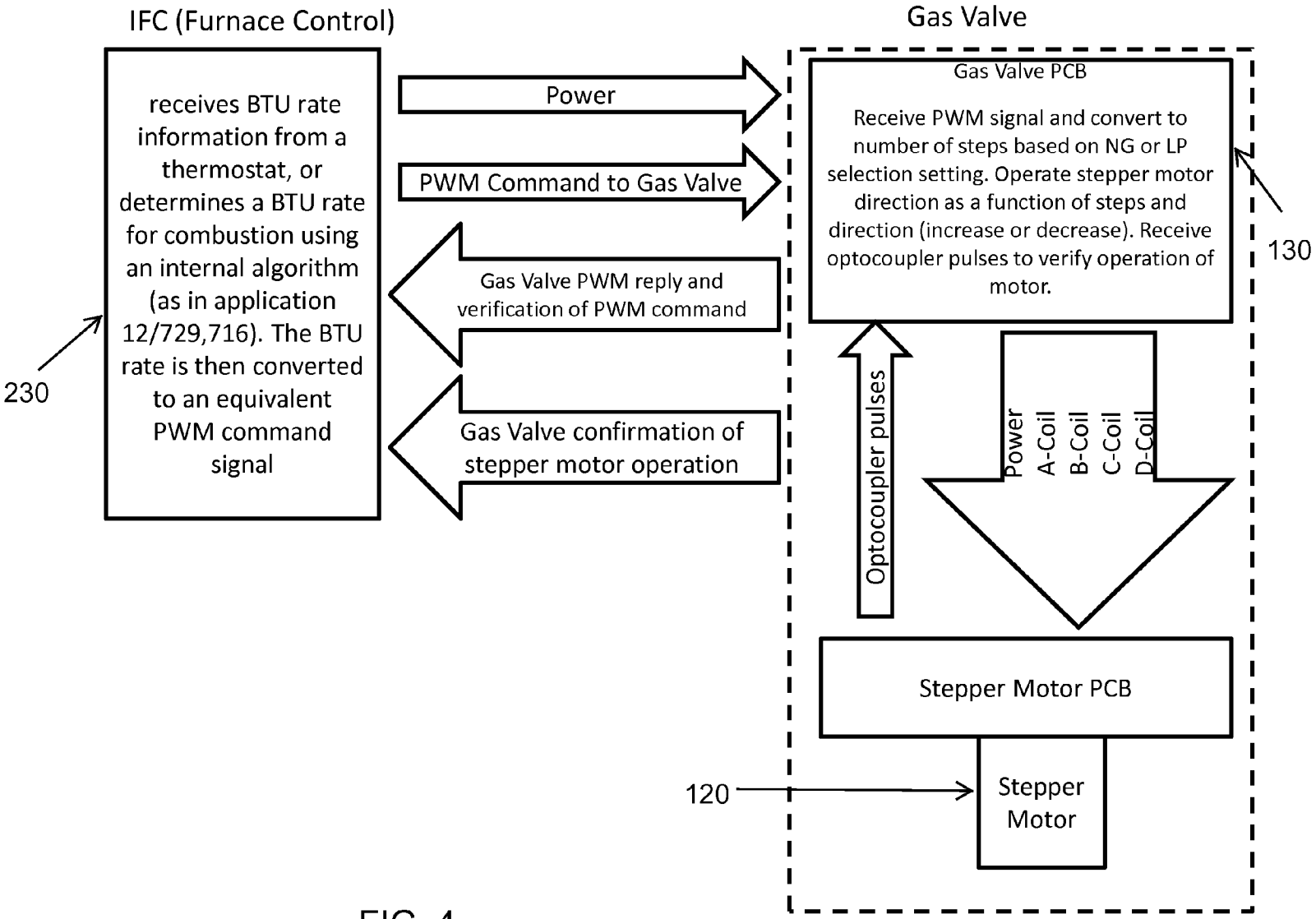
FIG. 4 is a system block diagram illustrating the communication control of the controller for the stepper motor operated gas valve, according to the present disclosure.

In use, the controller 130 and stepper motor operated gas valve 100 would be included within a fuel-fired heating apparatus 250 that includes a furnace controller 230 and a burner 258, as shown in FIG. 2. Referring to FIG. 4, the furnace controller 230 is operable to determine a desired operating capacity level (as disclosed in U.S. patent application Ser. No. 12/729,716), and to communicate to the valve controller 130 a PWM signal that is indicative of a desired operating capacity level. The controller 130 is configured to determine a required number of steps the stepper motor 120 must move to establish the requested operating capacity level, and to output a command to the stepper motor 120. It should be understood that the above stepper motor operated gas valve 100 is operable within a range of motor step values that correspond to a plurality of positions of the stepper motor 120 for adjusting the gas valve 100, which positions range between a closed no-flow position to a 100% full capacity position. The stepper motor 120 may be a variable reluctance linear stepper motor 120 having a shaft that is linearly displaced as the motor rotates in a stepwise manner. Such a stepper motor 120 may include four independent windings that define an A phase, a B phase, a C phase and a D phase. One or more of the phases of the stepper motor 120 may be selectively excited in the proper sequence to control the direction of rotation of the motor. Preferably, the four windings are connected in a manner to repeatedly excite pairs of windings in a sequence to effect rotation in a particular direction. For example, a ¼ pitch leftward movement may be established by excitation of pairing of phases in the order of A phase-D phase, D phase-B phase, B phase-C phase, C phase-A-phase. Similarly, a ¼ pitch rightward movement may be established by excitation of pairing of phases in the order of A phase-C phase, C phase-B phase, B phase-D phase, D phase-A-phase. The controller 130 provides for controlling a stepper motor 120, and the controller 130, the stepper motor 120, and gas valve 100 may all be part of a combined controller 130 and gas valve 100 component that are integrally manufactured or assembled as a unit.

Referring to FIG. 2, the controller 130 for controlling the stepper motor operated gas valve 100 is coupled to a 24-volt power source 52, which supplies power to a microprocessor 122 of the controller 130, and also the stepper motor operated gas valve 100. The controller 130 further includes at least a first input connector 124 configured to receive an input signal from the furnace controller 230 requesting heating operation at a specific operating capacity level. Upon detecting the presence of an input control signal requesting heating operation at a specific operating capacity level, the microprocessor 122 is configured to communicate a stepper motor control signal via a connection 136 to the stepper motor 120 to establish heating operation at the burner 258. The controller 130 is configured to control the stepper motor operated gas valve 100 to operate the variable capacity heating apparatus between a minimum and maximum heating capacity depending on heating demand, as explained below.

As stated above, the controller 130 has an input connector 124 configured to receive an input signal indicating a specific operating capacity level of heating. The controller 130 is preferably in communication with a stepper motor position sensor 160 (see FIG. 6) that is configured to detect the stepwise movements of the stepper motor 120. The controller 130 further includes a microprocessor 122 that is in communication with the stepper motor position sensor 160 and the input connector 124. The microprocessor 122 is configured to detect the presence of an input signal having an on period within a given frequency that is indicative of a specific operating capacity level at which to operate the heating apparatus 250 (see FIG. 2). Upon receipt of an input signal via input connector 124, the microprocessor 122 may be configured to respond to an input control signal by generating an output signal to the furnace controller 230 that echoes the input signal back to the furnace controller 230, to verify receipt of the input signal as shown at 506 in FIG. 5.

The microprocessor 122 further includes a programmable read-only-memory, and may additionally include a separate memory 132. The programmable read-only-memory is encoded with one or more instructions operable to determine the number of steps the stepper motor 120 must move to displace the servo-regulator diaphragm 110 (shown in FIG. 3) and vary the gas flow to correspond to the requested operating capacity level, and also to generate a stepper motor control signal instructing the stepper motor 120 to move the determined number of steps to displace the servo-regulator diaphragm 110 to establish a gas flow corresponding to the operating capacity level.

It should be noted that the microprocessor 122 is configured to generate control signals for each of the windings of the stepper motor 120. The microprocessor 122 preferably includes a first pin for controlling excitation of the A phase winding, a second pin for controlling excitation of the B phase winding, a third pin for controlling excitation of the C phase winding and a fourth pin for controlling excitation of the D phase winding. One example of a microprocessor 122 for the controller 130 is a PIC 18F45K22 microprocessor or dsPIC 33FJ32MC304 manufactured by Microchip Technologies, Inc. Alternatively, the microprocessor 122 may provide instructions to a second processor having four pins for controlling the stepper motor 120, such as a L297D stepper motor controller manufactured by SGS-Thomson. In addition to the first communication pin for receiving the pulse-width modulated input control signal from furnace controller 230, the microprocessor 122 may further include a second communication pin for sending an output signal, as explained below.

After the stepper motor 120 moves the determined number of steps, the microprocessor 122 is further configured or programmed to compare the determined number of steps with the number of steps the stepper motor 120 actually moves, as detected by the stepper motor position sensor 160, to verify the position of the stepper motor 120. The microprocessor 122 thereafter generates an output signal to the furnace controller 230, which output signal confirms that the stepper motor 120 has moved the number of steps needed to adjust the gas flow to establish the requested operating capacity level.

In the above embodiment, the controller 130 is configured to receive from the furnace controller 230 an input signal that is a pulse width modulated signal having a duty cycle ratio of between 4 percent and 95 percent. The input signal is preferably a signal having a frequency of between 13.1 Hertz and 17 Hertz, which signal is pulse-width-modulated, or repeatedly cycled between high and low amplitude, to provide a series of pulses having a given ratio of "high" versus "low" time. Accordingly, the input control signal is preferably a pulse width modulated signal having a duty cycle value that is based on a ratio of a time period in which the frequency signal is high, versus a subsequent time period in which the frequency signal is low. For example, a duty cycle value of 90 percent is calculated where a frequency signal is cycled between a "high" level for 90 milliseconds and a "low" level for 10 milliseconds, as shown at 502 in FIG. 5. The above signal may have a frequency of 15 Hertz, and a period of 0.0667 seconds, for example. For a 90 percent duty cycle, this frequency signal would be "high" for 0.06 seconds and low for the remainder of the 0.0677 second period. For a 30 percent duty cycle, the frequency signal is "high" for 0.02 seconds and low for the remainder of the 0.0677 second period. In this manner, the frequency is not varied, but rather the "high" versus "low" time of the signal is varied to indicate an operating capacity. In the above described embodiments, the input signal is a pulse width modulated signal in which the duty cycle may vary between about 30 percent and about 95 percent, which respectively corresponds to an operating capacity level that varies between about 35 percent and about 100 percent of the full operating capacity of the heating apparatus, as shown in TABLE 1 below. The controller 130 determines the required number of steps that the stepper motor 120 must move, depending on whether Liquid Propane or Natural gas is being used, to operate the gas valve 100 to establish the requested operating capacity level or flow rate as shown in TABLE 1 below.

TABLE 1

| Input | Operating capacity | Target pressure (inches H20) | | Step constants | |
|---|---|---|---|---|---|
| signal PWM | level (rate) | LP gas | Nat. gas | LP gas | Nat. gas |
| 30 | 35 | 1.23 | 0.43 | 255 | 216 |
| 35 | 40 | 1.6 | 0.56 | 280 | 224 |
| 40 | 45 | 2.03 | 0.71 | 309 | 234 |
| 45 | 50 | 2.5 | 0.87 | 349 | 244 |
| 50 | 55 | 3.03 | 1.06 | 383 | 255 |
| 55 | 60 | 3.6 | 1.26 | 418 | 268 |
| 60 | 65 | 4.23 | 1.48 | 458 | 282 |
| 65 | 70 | 4.9 | 1.71 | 499 | 297 |
| 70 | 75 | 5.63 | 1.97 | 545 | 313 |
| 75 | 80 | 6.41 | 2.24 | 593 | 330 |
| 80 | 85 | 7.23 | 2.53 | 644 | 348 |
| 85 | 90 | 8.11 | 2.83 | 699 | 368 |
| 90 | 95 | 9.03 | 3.16 | 757 | 389 |
| 95 | 100 | 10 | 3.50 | 824 | 410 |

Figure 5:
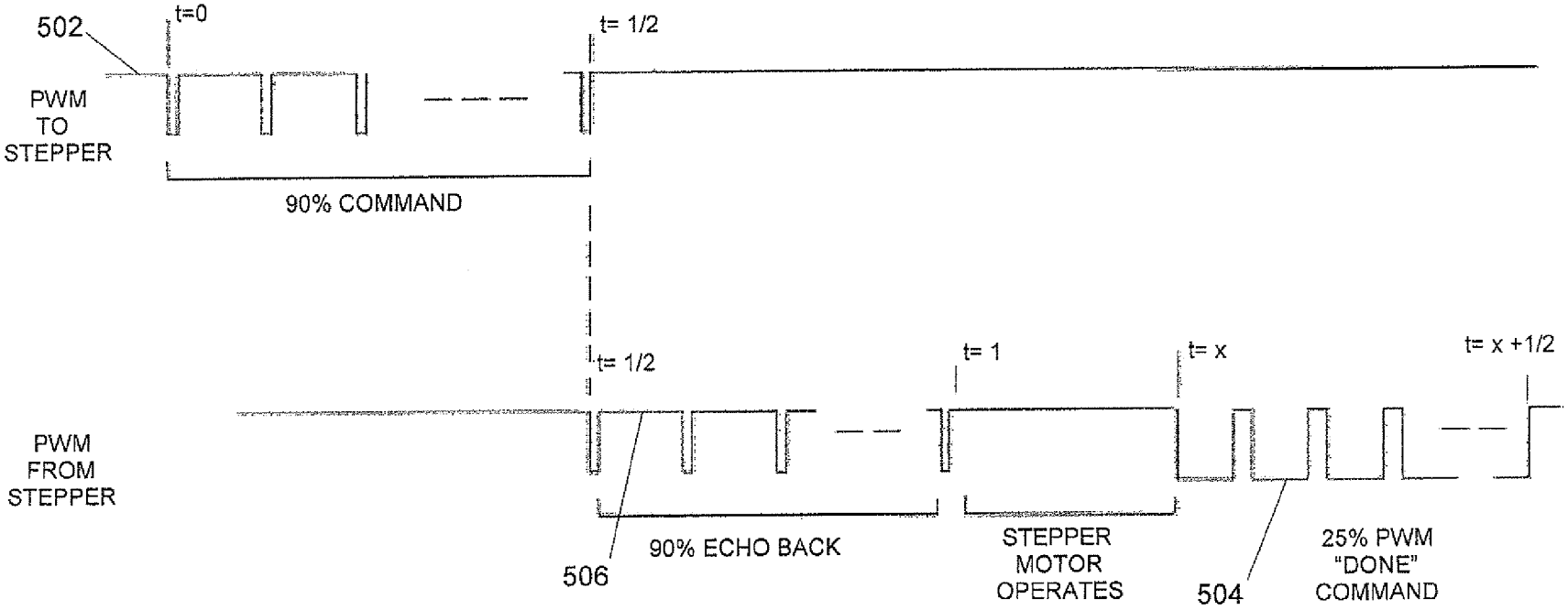
FIG. 5 is a graph of a control signal used in various controller embodiments in accordance with the principles of the present disclosure.

Upon moving the stepper motor 120 the determined number of steps, the controller 130 is configured to generate an output signal that is a pulse width modulated signal having a duty cycle ratio less than 30 percent (e.g., 25 percent for example), which duty cycle ratio is intended to confirm that the stepper motor moved the number of steps to establish the requested operating capacity level, as shown at 504 in FIG. 5. The controller 130 is further configured to respond to a pulse width modulated signal having a duty cycle ratio less than 30 percent (such as a duty cycle ratio between 4 and 6 percent, for example), which corresponds to a reset request. The controller 130 responds by generating a stepper motor control signal for instructing the stepper motor 120 to displace the servo-regulator diaphragm 110 as required to cause the main diaphragm 104 to close the valve opening 108 and restrict flow of gas through the gas valve 100. This enables the controller 130 to restrict flow of gas through the gas valve 100, such as when the thermostat and furnace controller 230 are no longer calling for operation of the heating apparatus 250. To verify that the stepper motor operated gas valve 100 has shut off, or to verify the actual position of the stepper motor operated gas valve 100, the furnace controller 230 may communicate a position request signal to the controller 130 for the stepper motor operated gas valve 100. For example, the controller 130 is configured to respond to a pulse width modulated input signal with a duty cycle ratio less than 30 percent (such as a duty cycle ratio between 14 and 16 percent, for example), which corresponds to a stepper motor position request from the furnace controller 230 by generating an output signal indicating the position of the stepper motor 120. The output signal communicating the position of the stepper motor 120 is preferably a pulse width modulated signal having a duty cycle ratio that is associated with an operating capacity level shown in TABLE 1 which corresponds to the steps the stepper motor 120 moved to reach its current position.

According to another aspect of the present disclosure, the controller 130 is configured to determine whether the input signal is a valid command, whether the stepper motor 120 has moved the required number of steps, whether the stepper motor 120 has closed the valve opening to shut off the valve or if there is a leak, whether there is a defective coil winding on the gas valve 100, or an excessive pressure within the valve chambers, or other diagnostic evaluations. The controller 130 may further include one or more indicia devices 134 as shown in FIG. 1, such as one or more light emitting diodes (LED) or audible alarm devices, which are in connection with the microprocessor 122 of the controller 130. The microprocessor 122 may be configured to control the one or more indicia devices 134 to either remain on or blink or beep a predetermined sequence for indicating one or more diagnostic problems as described above. Accordingly, unlike conventional gas valves which do not communicate and are merely instructed to open or close, the controller 130 for the stepper motor operated gas valve 100 in the above embodiment is configured to diagnose one or more operating problems, and to control at least one indicia device 134 to indicate one or more diagnostic conditions.

The above described embodiment of a controller 130 may be utilized with various stepper motors that are configured to detect the position of the stepper motor and the number of steps that the stepper motor has moved. One embodiment of a stepper motor may include one or more sensing coils disposed in the stator such that the sensing coils output an induced voltage signal when the rotor is rotated, and a controller that processes the induced voltage signals. The controller determines the rotor displacement based on information derived from the induced voltage signals, to track the rotor step position and the rotor's displacement position. Such a stepper motor control is disclosed in U.S. patent application Ser. No. 12/484,843, filed Jun. 15, 2009, entitled "System and Method of Step Detection For A Stepper Motor." The above described controller 130 for controlling a stepper motor 120 may also be utilized with other embodiments of a stepper motor operated gas valve 100, such as that described below.

Figure 6:
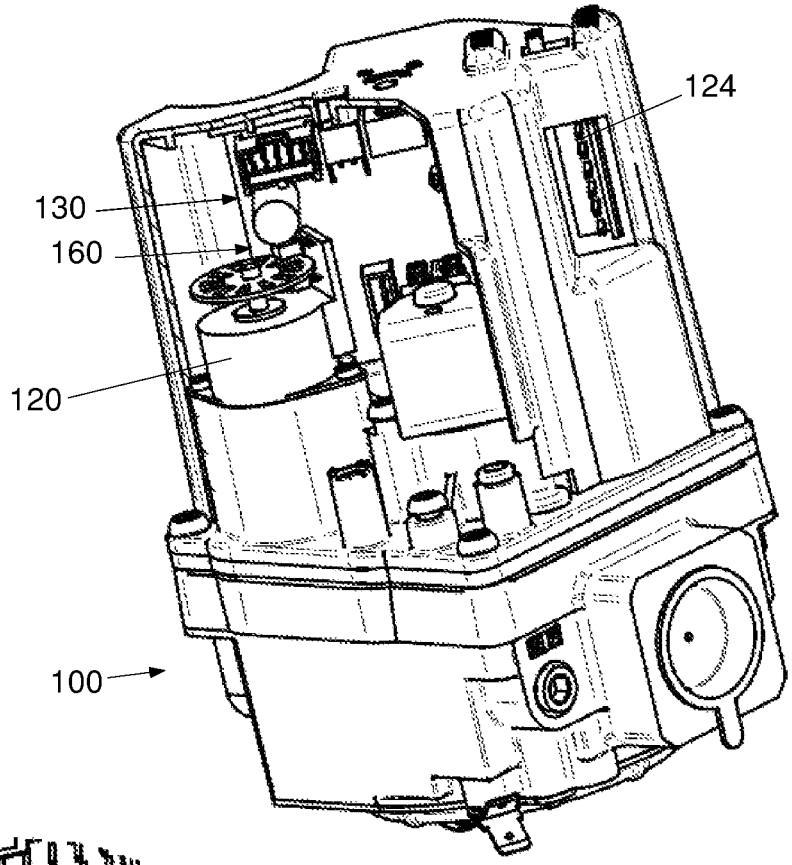
FIG. 6 shows a cut-away view of a second embodiment of a stepper motor operated gas valve, according to the principles of the present disclosure.
Figure 7:
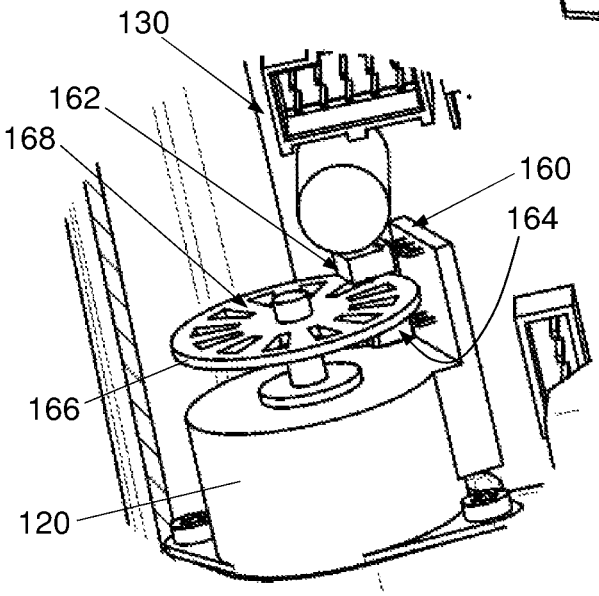
FIG. 7 shows a cut-away view of a portion of the stepper motor operated gas valve of FIG. 6.

Referring to FIGS. 6-7, a stepper motor operated gas valve 100 is shown. The stepper motor operated gas valve 100 in FIGS. 6-7 is similar in construction to gas valve 100, and includes a valve element 106 movable relative to a valve opening 108 in the gas valve 100, a main diaphragm chamber 102 having a main diaphragm 104 disposed therein that is coupled to the valve element 106, as shown in FIG. 3. The main diaphragm 104 is configured to controllably displace the valve element 106 relative to the valve opening 108 in response to changes in gas pressure acting against the main diaphragm 104. The stepper motor operated gas valve 100 in FIGS. 6-7 also includes a servo-regulator diaphragm 110 as shown in FIG. 3, which is configured to regulate flow of gas to the main diaphragm chamber 102 that acts against the main diaphragm 104, to thereby adjust the valve element 106 to vary the flow rate of gas through the valve opening 108. The stepper motor operated gas valve 100 in FIGS. 6-7 further includes a stepper motor 120 that is configured to move in a stepwise manner to displace the servo-regulator diaphragm for varying the flow of gas to the diaphragm chamber, to thereby control the rate of gas flow through the valve opening 108.

As shown in FIG. 7, the stepper motor 120 further includes a stepper motor position sensor 160. The stepper motor position sensor 160 is configured to detect the stepwise movements of the stepper motor 120. The stepper motor position sensor 160 includes a stationary light emitting diode 162 and a stationary optical sensor 164. The stepper motor position sensor 160 further includes an encoder 166 with radially extending fingers 168, which is coupled to the shaft of the stepper motor 120 so that the fingers 168 rotate relative to the optical sensor 164 as the motor rotates, such that the position sensor 160 is configured to detect rotation of a specific number of fingers 168 that correspond to a specific number of steps that the stepper motor 120 has moved. Accordingly, the controller 130 is configured to compare the determined number of steps with the number of steps the stepper motor 120 moves as detected by the stepper motor position sensor 160, to verify the position of the stepper motor 120 and confirm that the stepper motor 120 has moved the number of steps required to adjust the gas flow to establish the operating capacity level requested in the input signal.

It will be understood by those skilled in the art that the above variable capacity heating apparatus controller may be employed in various types of heating systems with any combination of the above disclosed features, without implementing the others. It will be understood that the stepper motor driven gas valve and controller described above may be utilized in other forms of heating and cooling equipment, including water heater and boiler appliances. Accordingly, it should be understood that the disclosed embodiments, and variations thereof, may be employed without departing from the scope of the invention.

What is claimed is:

1. A system including a controller in combination with a stepper motor operated gas valve configured to vary the gas flow rate for varying the level of heating operation of a heating apparatus, the system comprising:

a valve element movable relative to a valve opening in the gas valve;

a main diaphragm chamber disposed in the gas valve;

a main diaphragm disposed in the main diaphragm chamber and coupled to the valve element, the main diaphragm being configured to controllably displace the valve element relative to the valve opening in response to changes in gas pressure acting against the main diaphragm;

a servo-regulator diaphragm configured to regulate flow of gas to the main diaphragm chamber that acts against the main diaphragm, to thereby adjust the valve element to vary the flow rate of gas through the valve opening;

a stepper motor configured to move in a stepwise manner to displace the servo-regulator diaphragm for varying the flow of gas to the diaphragm chamber, to thereby control the rate of gas flow through the valve opening; and a stepper motor position sensor configured to detect the stepwise movements of the stepper motor;

the controller having an input connector configured to receive an input signal from a furnace controller, the input signal from the furnace controller comprising a pulse-width-modulation signal having a specified duration and a duty cycle ratio indicative of a desired operating capacity level at which to operate the heating apparatus, and the controller having a microprocessor in communication with the stepper motor position sensor and the input connector of the controller to receive the input signal from the furnace controller, the microprocessor including a programmable memory encoded with one or more instructions operable to determine the number of steps the stepper motor must move to displace the servo-regulator diaphragm to establish a gas flow rate corresponding to the desired operating capacity level indicated by the PWM input signal from the furnace controller, generate a stepper motor control signal that causes the stepper motor to move the determined number of steps to displace the servo-regulator diaphragm to establish the gas flow rate corresponding to the desired operating capacity level, and compare the determined number of steps with the number of steps the stepper motor actually moves as detected by the stepper motor position sensor, to verify the position of the stepper motor;

wherein the microprocessor is configured to respond to the furnace controller when the PWM input signal is received from the furnace controller by generating an output signal to the furnace controller that echoes the PWM input signal prior to generating the stepper motor control signal to move the stepper motor, thereby allowing the furnace controller to verify the correct PWM input signal was received at the microprocessor, the microprocessor is configured to respond to a PWM input signal from the furnace controller having a duty cycle below a predetermined threshold that corresponds to a reset request from the furnace controller by generating a stepper motor control signal instructing the stepper motor to displace the servo-regulator diaphragm as required to close the valve opening and shut off the gas valve, and the microprocessor is configured to generate an output signal to the furnace controller after the stepper motor has moved confirming that the stepper motor has moved the number of steps to establish the gas flow rate corresponding to the desired operating capacity level indicated in the input signal.

2. The system of claim 1, wherein the input signal is a pulse width modulated signal having a duty cycle ratio of between 4 percent and 95 percent.

3. The system of claim 1, wherein the input signal is a pulse width modulated signal, in which a duty cycle that varies between about 30 percent and about 95 percent respectively corresponds to an operating capacity level that varies between about 35 percent and about 100 percent of the full operating capacity of the heating apparatus.

4. The system of claim 1, wherein the controller is configured to generate an output signal that is a pulse width modulated signal having a duty cycle ratio less than about 30 percent, to confirm that the stepper motor has moved the number of steps to establish the gas flow rate corresponding to the desired operating capacity level.

5. The system of claim 1, wherein the predetermined threshold is a duty cycle ratio of about 30 percent.

6. The system of claim 1, wherein the controller is configured to respond to a pulse width modulated signal having a duty cycle ratio less than 30 percent that corresponds to a stepper motor position request by generating an output signal that is a pulse width modulated signal having a duty cycle ratio associated with a specific operating capacity level that corresponds to the number of steps the stepper motor has moved to reach its current position.

7. The system of claim 1, wherein the controller is configured to diagnose one or more operating problems, and to control at least one indicia device to indicate one or more diagnostic conditions.

8. A system for controlling the operating capacity level of a variable capacity heating apparatus, the system comprising:

a valve element movable relative to a valve opening in the gas valve;

a main diaphragm chamber disposed in the gas valve;

a main diaphragm disposed in the main diaphragm chamber and coupled to the valve element, the main diaphragm being configured to displace the valve element relative to the valve opening in response to changes in pressure acting against the main diaphragm;

a servo-regulator diaphragm for regulating gas flow to the main diaphragm chamber for controlling the pressure that acts against the main diaphragm and moves the valve element to vary the flow rate of gas through the valve opening;

a stepper motor configured to move in a stepwise manner to displace the servo-regulator diaphragm for varying the gas flow to the main diaphragm chamber, to thereby control the rate of gas flow through the valve opening;

a stepper motor position sensor configured to detect the stepwise movements of the stepper motor;

a furnace controller configured to communicate an input signal comprising a pulse-width-modulation signal having a specified duration and a duty cycle ratio that is indicative of a specific level of heating operation for the variable capacity heating apparatus;

a controller for controlling operation of the stepper motor, the controller having a microprocessor in communication with the stepper motor position sensor and the furnace controller, the microprocessor configured to detect the presence of an input signal from the furnace controller that is indicative of a desired operating capacity level, the microprocessor including a programmable memory encoded with one or more instructions operable to determine the number of steps the stepper motor must move to displace the servo-regulator diaphragm to establish a gas flow rate corresponding to the desired operating capacity level, generate a stepper motor control signal that causes the stepper motor to move the determined number of steps to displace the servo-regulator diaphragm to establish the gas flow rate corresponding to the desired operating capacity level, compare the determined number of steps with the number of steps the stepper motor actually moves, as detected by the stepper motor position sensor, to verify the position of the stepper motor; and generate an output signal to the furnace controller confirming that the stepper motor has moved the number of steps to establish the gas flow rate corresponding to the desired operating capacity level requested by the furnace controller;

wherein the microprocessor is further configured to respond to the receipt of the input signal from the furnace controller by generating an output signal to the furnace controller that echoes the input signal, prior to generating the stepper motor control signal to move the stepper motor, to verify receipt of the input signal to the furnace controller, and to respond to an input signal from the furnace controller having a duty cycle below a predetermined threshold that corresponds to a reset request from the furnace controller, by generating a stepper motor control signal instructing the stepper motor to displace the servo-regulator diaphragm as required to close the valve opening and shut off the gas valve.

9. The system of claim 8, wherein the input signal is a pulse width modulated signal having a duty cycle ratio of between 4 percent and 95 percent.

10. The system of claim 8, wherein the input signal is a pulse width modulated signal, in which a duty cycle that varies between about 30 percent and about 95 percent respectively corresponds to an operating capacity level that varies between about 35 percent and about 100 percent of the full operating capacity of the variable capacity heating apparatus.

11. The system of claim 8, wherein the controller is configured to generate an output signal that is a pulse width modulated signal having a duty cycle ratio less than about 30 percent, to confirm that the stepper motor has moved the number of steps to establish the desired operating capacity level.

12. The system of claim 9, wherein the predetermined threshold is a duty cycle ratio of about 30 percent.

13. The system of claim 8, wherein the controller is configured to diagnose one or more operating problems, and to control at least one indicia device to indicate one or more diagnostic conditions.

14. The system of claim 13, wherein the indicia device includes one or more light emitting diodes and/or audible alarm devices.

15. The system of claim 13, wherein the one or more diagnostic conditions include at least one of whether the input signal is a valid command, whether the stepper motor has moved the required number of steps, whether the stepper motor has closed the valve opening to shut off the valve, whether there is a leak, whether there is a defective coil winding on the gas valve, and whether there is an excessive pressure within one or more valve chambers.

16. The system of claim 7, wherein:

the indicia device includes one or more light emitting diodes and/or audible alarm devices; and the one or more diagnostic conditions include at least one of whether the input signal is a valid command, whether the stepper motor has moved the required number of steps, whether the stepper motor has closed the valve opening to shut off the valve, whether there is a leak, whether there is a defective coil winding on the gas valve, and whether there is an excessive pressure within one or more valve chambers.

17. The system of claim 1, wherein the specified duration of the pulse-width-modulation signal is about 0.5 seconds.

18. The system of claim 8, wherein the specified duration of the pulse-width-modulation signal is about 0.5 seconds.

* * * * *